United States Patent [19]

Polizzano

[11] 4,057,313

[45] Nov. 8, 1977

[54] TEST CLIP

[76] Inventor: Ida Polizzano, 235 S. Harrison St. Apt. 308, East Orange, N.J. 07018

[21] Appl. No.: 706,171

[22] Filed: July 19, 1976

[51] Int. Cl.[2] ..... H01R 11/24; H01R 27/00

[52] U.S. Cl. ..... 339/33; 339/97 T; 339/255 P

[58] Field of Search ..... 339/31-33, 339/97 T, 108 TP, 200 P, 255 P, 260, 261

[56] References Cited

U.S. PATENT DOCUMENTS

| | | | |
|---|---|---|---|
| 953,678 | 3/1910 | Luther | 339/108 TP |
| 1,188,749 | 6/1916 | Frankel | 339/97 T |
| 1,547,314 | 7/1925 | Frankel | 339/255 P |
| 2,477,642 | 8/1949 | Novello | 339/31 T |
| 3,506,944 | 4/1970 | Potruch | 339/255 P |

*Primary Examiner*—Roy Lake
*Assistant Examiner*—Neil Abrams
*Attorney, Agent, or Firm*—Allen D. Brufsky

[57] ABSTRACT

An alligator clip for testing electrical circuits is provided with a spring clip on one conductive leg of the alligator clip for slidably receiving a termination on a terminal board for testing the same.

2 Claims, 3 Drawing Figures

TEST CLIP

BACKGROUND OF THE INVENTION

This invention relates to a connecting device for investigation and testing of electric circuits.

Existing type connecting devices or test clips, such as alligator clips, are too bulky and cumbersome to be used on testing newer types of wire terminations widely in use in the communications industry. This invention provides a tool containing a test clip which simply slides on to a newer type of wire terminal for conducting various testing procedures, as well containing an alligator clip for use on conventional terminals.

SUMMARY OF THE INVENTION

In accordance with the invention, a resilient spring clip is attached to the conducting leg of an alligator clip for slidably receiving a wire terminal of a terminal board to connect the terminal through the alligator clip to circuit testing equipment. The alligator clip can also be used to test conventional terminal by securement of the jaws of the alligator clip to these terminals, providing one tool for testing both types of circuits.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
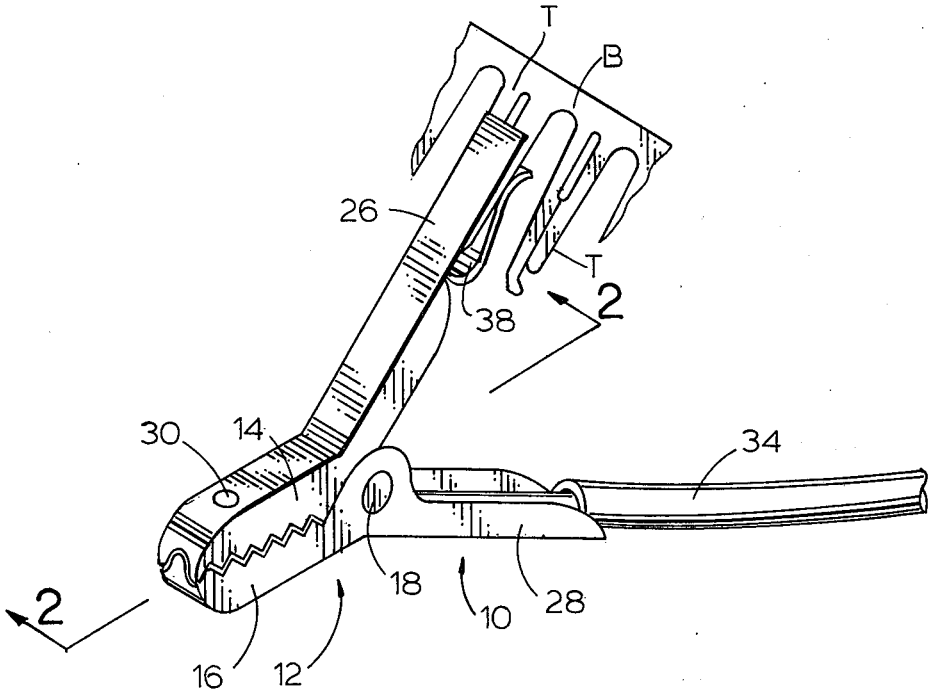
FIG. 1 is a perspective view of the connecting device of the present invention.
Figure 2:
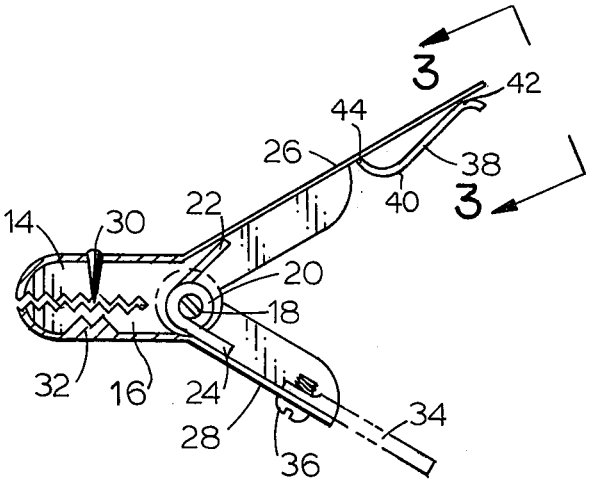
FIG. 2 is a cross-sectional view taken substantially along the plane indicated by line 2—2 of FIG. 1.
Figure 3:
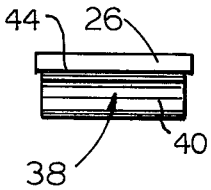
FIG. 3 is a side view in elevation of a portion of the connecting device as seen along the plane indicated by line 3—3 of FIG. 2.

Referring now in detail to the drawing, wherein like numerals indicate like elements throughout the several views, the connecting device 10 of the present invention includes an alligator clip portion 12 having serrated conductive jaws 14 and 16 for gripping a conventional circuit terminal.

Jaws 14 and 16 are hinged together on a common pivot pin 18. A coil spring 20 wound about pin 18 has opposite ends 22 and 24 in contact with conductive legs 26 and 28, respectively, comprising extensions of jaws 14 and 16, respectively, to bias the jaws 14 and 16 towards each other. When legs 26 and 28 are moved towards each other, jaws 14 and 16 will open and a conventional terminal can be disposed therebetween. A spike 30 secured to jaw 14 cooperates with a lower inside jaw 32 on jaw 16 for use in piercing an insulated conductor to test the circuit in which the conductor appears.

A wire 34 is soldered or connected by a screw 36 to leg 28 of alligator clip portion 12 to electrically connect the terminal or wire gripped in jaws 14, 16 to a suitable testing device.

The alligator clip jaws 14 and 16 are too bulky and cumbersome, however, to grip and test the terminals on a modern terminal board B, without gripping or interfering with other terminals on board B. Accordingly, a resilient elongated conductive spring clip 38 is connected at one end to the bottom outer surface of leg 26 to serve as a test clip for terminal T, which is slidingly received within clip 38, as shown in FIG. 1. Clip 38 provides a pair of oppositely extending arcuate end portions 40 and 42 with the transverse edge 44 of the arcuate end portion 40 being fixedly secured to the leg 26. The arcuate end portion 42 is inwardly self-biased by the inherent resiliency of the clip 38 toward the leg 26. Therefore, clip 38 frictionally retains and conductively engages the terminal T of board B electrically connecting the same to leg 26. The electrical connection from terminal T to wire 34 is made through leg 26, jaws 14, 16, and leg 28.

I claim:

1. An electrical test connecting device comprising:

an alligator clip including a pair of conductive gripping jaws attached to each other and a conductive leg connected to each jaw, an inner surface of one leg being opposed to an inner surface of the other leg, spring means for biasing said jaws towards each other, an electrical conductor connected to one of said legs adapted to be connected to a testing device; and a conductive clip attached to the inner surface of said other leg, said clip being resilient, elongated, and providing oppositely longitudinally extending arcuate end portions, one of said arcuate end portions being fixedly secured on the transverse edge thereof to said inner surface, said other arcuate end portion being biased toward said other leg, said clip adapted to frictionally retain and conductively engage an electrical terminal disposed between said clip and the inner surface of said other leg.

2. An electrical test connecting device in accordance with claim 1, wherein one of said jaws includes a spike in the interior thereof and the other of said jaws includes an interior jaw opposite to said spike.

* * * * *